US006467421B1

(12) United States Patent
Conley

(10) Patent No.: US 6,467,421 B1
(45) Date of Patent: Oct. 22, 2002

(54) BREACH FILLING DEVICE

(76) Inventor: John Edgar Conley, 2038 Palm St. #508, Las Vegas, NV (US) 89104

( * ) Notice: Subject to any disclaimer, the term of this patent is extended or adjusted under 35 U.S.C. 154(b) by 0 days.

(21) Appl. No.: 09/815,701

(22) Filed: Mar. 23, 2001

(51) Int. Cl.[7] ..... B63B 43/16
(52) U.S. Cl. ..... 114/227
(58) Field of Search ..... 29/700; 114/227–229

(56) References Cited

U.S. PATENT DOCUMENTS

| | | | | |
|---|---|---|---|---|
| 5,845 A | | 10/1848 | Seely | |
| 2,220,085 A | | 11/1940 | Dirschel | |
| 3,841,256 A | | 10/1974 | Etchelecou et al. | |
| 4,012,822 A | * | 3/1977 | Vrolyk et al. | 138/89 |
| 4,329,132 A | * | 5/1982 | Melvoid et al. | 114/227 |
| 4,390,333 A | * | 6/1983 | Dubois | 114/227 |
| 5,143,012 A | | 9/1992 | Elkowitz | |
| 5,245,941 A | | 9/1993 | Gattuso | |
| 5,253,602 A | | 10/1993 | Moriarty | |
| 6,058,870 A | | 5/2000 | Conley | |

FOREIGN PATENT DOCUMENTS

| | | |
|---|---|---|
| DE | 41 34 013 A1 * | 4/1993 |
| FR | 2 808 499 * | 11/2001 |

* cited by examiner

*Primary Examiner*—Sherman Basinger

(57) ABSTRACT

A new breach filling device for plugging a hole in a structure, such as, for example, a boat. The inventive device includes a container having a plurality of reservoirs therein for holding components of a foaming material in the reservoirs. A flexible inflatable bladder has an interior space. A conduit system is for fluidly connecting the reservoirs of the container with the interior space of the inflatable bladder. The conduit system is designed to convey the components of the foaming material separately between the container and the inflatable bladder. The conduit system is designed to discharge the components into the interior space of the bladder such that mixing of the components occurs in the interior space and the foaming material forms a foamed material in the interior space for inflating the inflatable bladder.

13 Claims, 6 Drawing Sheets

BREACH FILLING DEVICE

BACKGROUND OF THE INVENTION

1. Field of the Invention

The present invention relates to hole plugging devices and more particularly pertains to a new breach filling device for plugging a hole in a structure, such as, for example, a boat.

2. Description of the Prior Art

The use of hole plugging devices is known in the prior art. One such type of device is described in my U.S. Pat. No. 6,058,870. While the device disclosed in that patent can be highly effective for closing and plugging holes, certain improvements have been desired for further simplifying the structure and function of the disclosed device.

The breach filling device according to the present invention substantially departs from the conventional concepts and designs of the prior art, and improves upon my previously patented device, and in so doing provides an apparatus primarily developed for the purpose of plugging a hole in a structure, such as, for example, a boat.

SUMMARY OF THE INVENTION

In view of the foregoing disadvantages inherent in the known types of hole plugging devices now present in the prior art, the present invention provides a new breach filling device construction wherein the same can be utilized for plugging a hole in a structure, such as, for example, a boat.

The general purpose of the present invention, which will be described subsequently in greater detail, is to provide a new breach filling device apparatus and method which has many of the advantages of the hole plugging devices mentioned heretofore and many novel features that result in a new breach filling device which is not anticipated, rendered obvious, suggested, or even implied by any of the prior art hole plugging devices, either alone or in any combination thereof.

To attain this, the present invention generally comprises a container having a plurality of reservoirs therein for holding components of a foaming material in the reservoirs. A flexible inflatable bladder has an interior space. A conduit system is for fluidly connecting the reservoirs of the container with the interior space of the inflatable bladder. The conduit system is designed to convey the components of the foaming material separately between the container and the inflatable bladder. The conduit system is designed to discharge the components into the interior space of the bladder such that mixing of the components occurs in the interior space and the foaming material forms a foamed material in the interior space for inflating the inflatable bladder.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new breach filling device apparatus and method which has many of the advantages of the hole plugging devices mentioned heretofore and many novel features that result in a new breach filling device which is not anticipated, rendered obvious, suggested, or even implied by any of the prior art hole plugging devices, either alone or in any combination thereof.

It is another object of the present invention to provide a new breach filling device which may be easily and efficiently manufactured and marketed.

It is a further object of the present invention to provide a new breach filling device which is of a durable and reliable construction.

An even further object of the present invention is to provide a new breach filling device which is susceptible of a low cost of manufacture with regard to both materials and labor, and which accordingly is then susceptible of low prices of sale to the consuming public, thereby making such breach filling device economically available to the buying public.

Still yet another object of the present invention is to provide a new breach filling device which provides in the apparatuses and methods of the prior art some of the advantages thereof, while simultaneously overcoming some of the disadvantages normally associated therewith.

Still another object of the present invention is to provide a new breach filling device for plugging a hole in a structure, such as, for example, a boat.

Yet another object of the present invention is to provide a new breach filling device which includes a container having a plurality of reservoirs therein for holding components of a foaming material in the reservoirs. A flexible inflatable bladder has an interior space. A conduit system is for fluidly connecting the reservoirs of the container with the interior space of the inflatable bladder. The conduit system is designed to convey the components of the foaming material separately between the container and the inflatable bladder. The conduit system is designed to discharge the components into the interior space of the bladder such that mixing of the components occurs in the interior space and the foaming material forms a foamed material in the interior space for inflating the inflatable bladder.

Still yet another object of the present invention is to provide a new breach filling device that may be used to plug a breach in the hull of a boat from both inside and outside the boat.

Even still another object of the present invention is to provide a new breach filling device that is portable so that it may be quickly and easily transported to the breach location.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
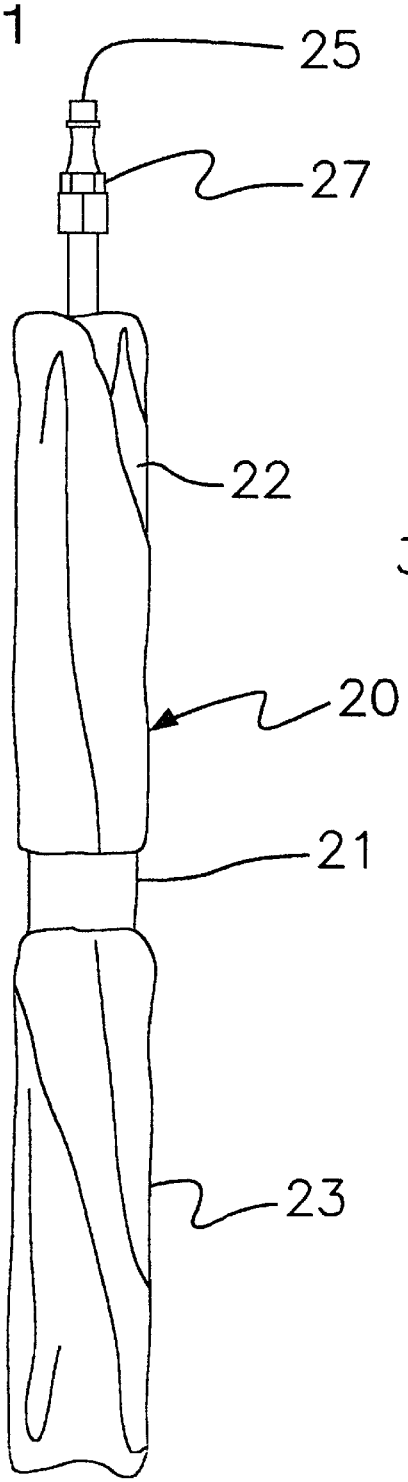
FIG. 1 is a schematic side view of a deflated bladder inflatable of a new breach filling device according to the present invention.

With reference now to the drawings, and in particular to FIGS. 1 through 8 thereof, a new breach filling device embodying the principles and concepts of the present invention and generally designated by the reference numeral 10 will be described.

In use, the breach filling device 10 is designed for providing a water-tight plug of a hole 2 in a structure 1 such as a breach in a hull or bulkhead of a boat. The breach filling device may be used from the interior side of the breach or from the water side of the breach to close the breach. As best illustrated in FIGS. 1 through 8, the breach filling device 10 generally comprises a container 11 having a plurality of reservoirs for holding a foaming material therein and a flexible inflatable bladder 20 having an interior space. The interior space of the inflatable bladder 20 is in fluid communication with the reservoir of the container 11 to permit passage of foaming material from the reservoirs of the container 11 into an interior space of the inflatable bladder 20. The foaming material forms a foamed material in the interior space of the inflatable bladder 20 such that the foamed material inflates the inflatable bladder 20.

Figure 2:
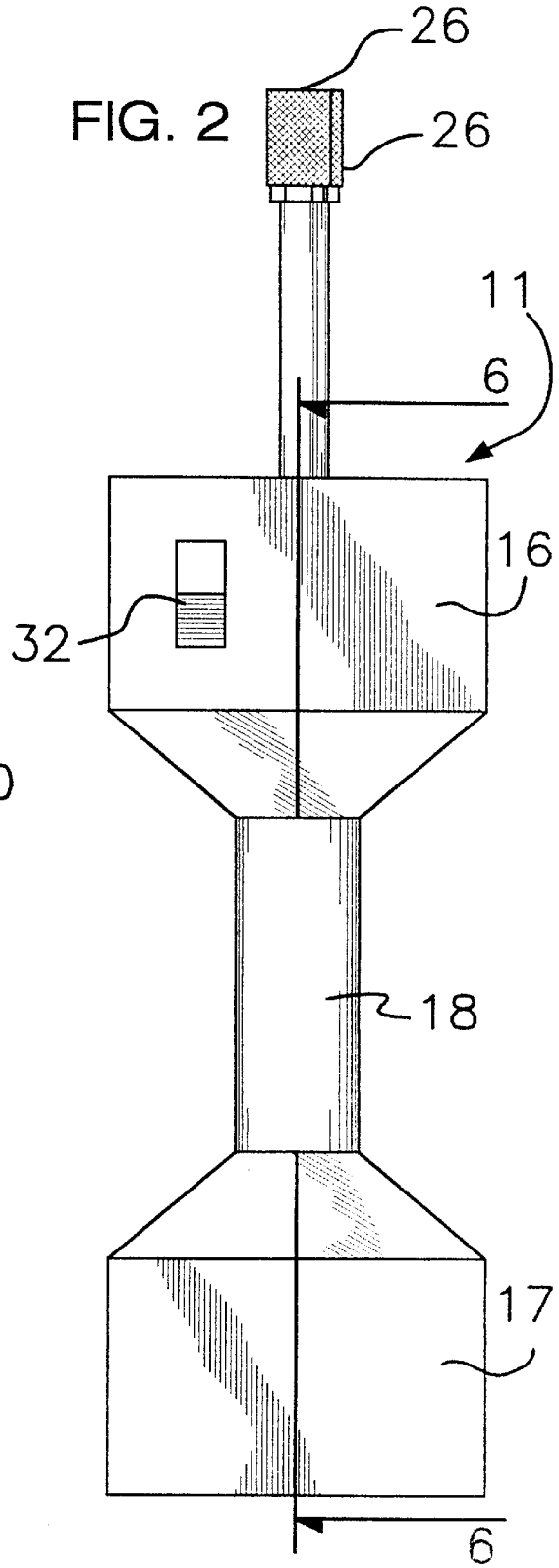
FIG. 2 is a schematic side view of the container of the present invention.

In closer detail, the portable container 11 has a plurality of reservoirs therein for holding a foaming fluidic material therein. Ideally, the foaming material comprises a two component foaming polymer fluidic material 12,13, such as a urethane and a reagent. Preferably, the reservoirs of the container 11 comprise separate first and second component reservoirs 14,15 for keeping the components 12,13 of the foaming material separate in the container 11. In particular, the first component reservoir 14 is designed for holding one of the components 12 of the foaming material and the second component reservoir 15 is designed for holding the other component 13 of the foaming material. In the ideal embodiment, as illustrated in FIG. 2, the container 11 is generally dumbbell-shaped and has a pair of spaced apart end portions 16,17 and a generally cylindrical handle 18 portion connecting the end portions 16,17 of the container 11 together. The handle 18 is designed for permitting easy grasping of the container 11 by a user, while enhancing the size of the reservoirs in the container.

Figure 3:
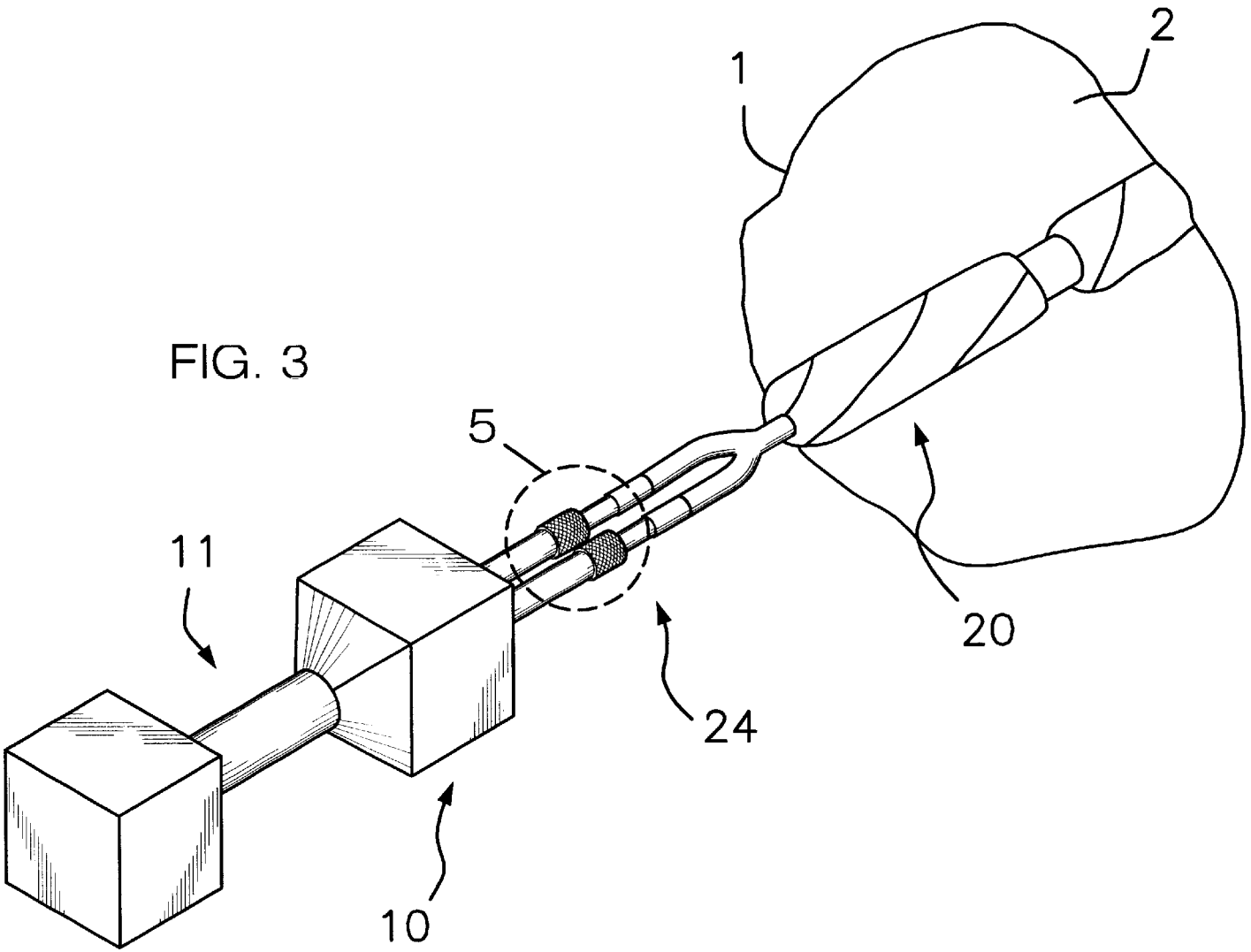
FIG. 3 is a schematic perspective view of the present invention with the deflated inflatable bladder in use being inserted into a hole in a structure.
Figure 4:
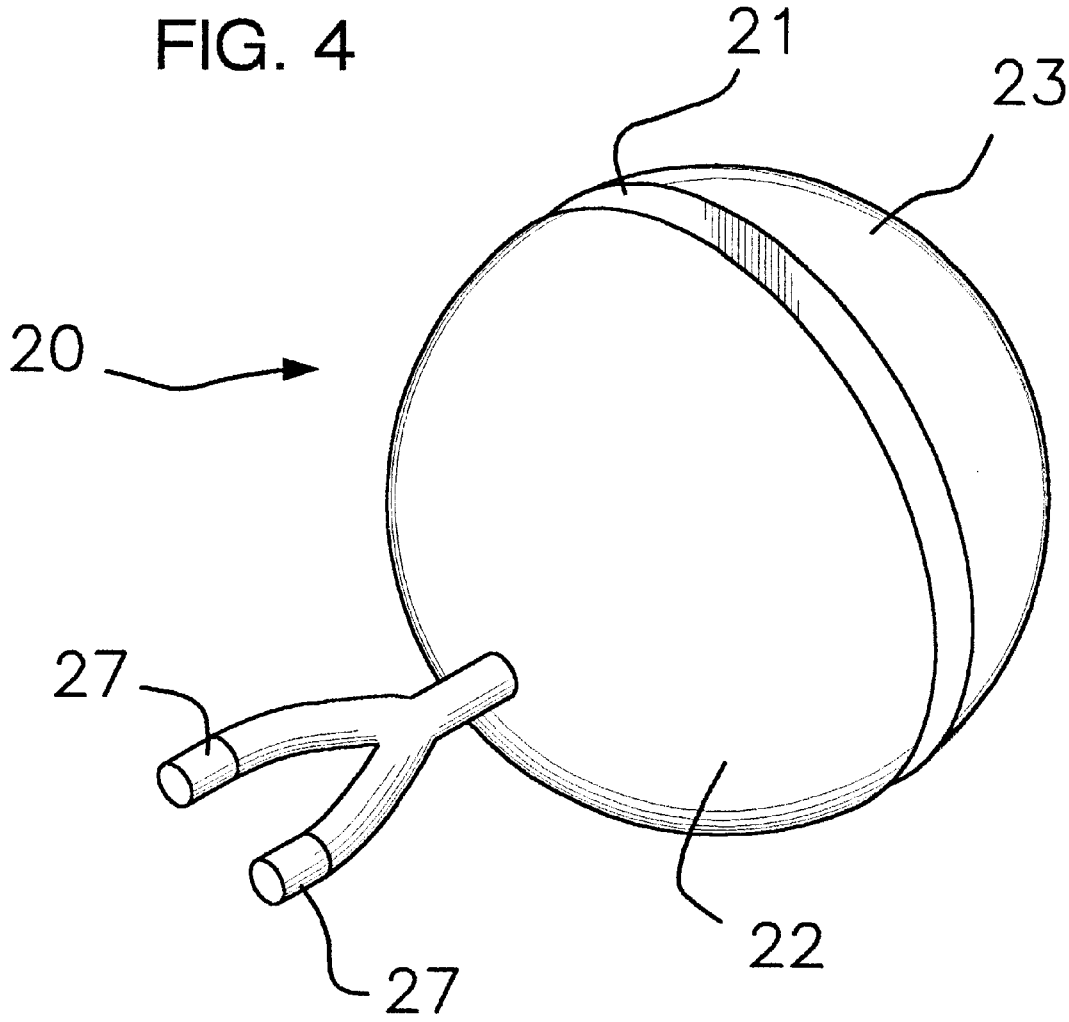
FIG. 4 is a schematic perspective view of an inflated inflatable bladder of the present invention.
Figure 8:
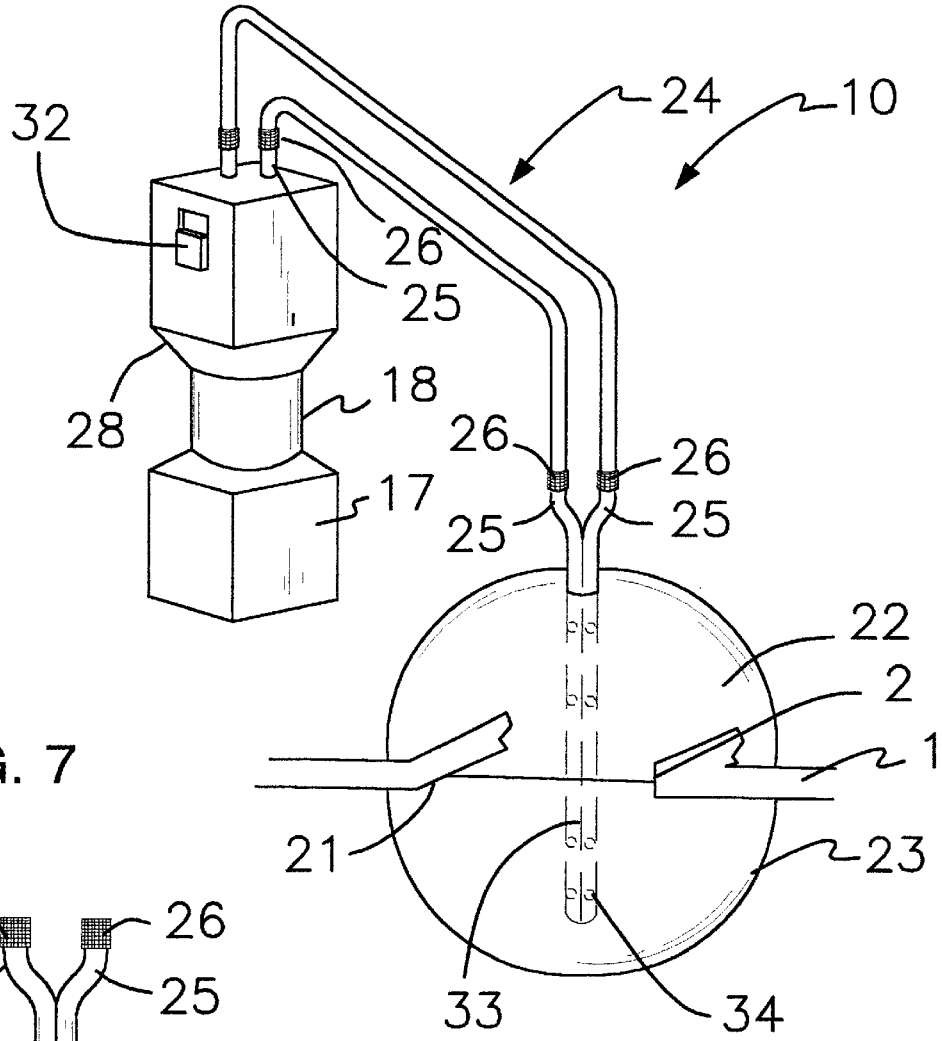
FIG. 8 is a schematic view of the present invention in use plugging a hole in a structure.

The breach filling device 10 also includes a flexible inflatable bladder 20 having an interior space. With reference to FIGS. 3 and 8, the inflatable bladder 20 is designed for inserting into a hole 2 in a structure 1 so that expansion or inflation of the inflatable bladder 20 closes the hole 2 in the structure 1. Preferably, inflation of the inflatable bladder 20 provides a substantially water tight closure of the hole 2 in the structure 1. As illustrated in FIG. 4, the inflatable bladder 20 may be generally spherical when inflated. Ideally, the inflatable bladder 20 comprises a rip resistant flexible material so that it can conform to unevenly shaped holes in a structure and will not be easily punctured by any sharp edges around the hole in the structure. The inflatable bladder 20 has an annular constriction 21, or seam, around the circumference of the inflatable bladder 20. The annular constriction 21 divides the inflatable bladder 20 into a pair of preferably generally hemispherical portions 22,23. The annular constriction 21 defines an annular channel between the portions 22,23 of the inflatable bladder 20. As illustrated in FIG. 8, the annular channel of the inflatable bladder 20 is designed for receiving the portion of the structure 1 around the periphery of the hole 2 in the structure 1 when the inflatable bladder 20 is inserted into the hole 2 in the structure 1 and inflated such that the structure 1 is sandwiched between the circumferences of the hemispherical portions 22,23 of the inflatable bladder 20.

Figure 5:
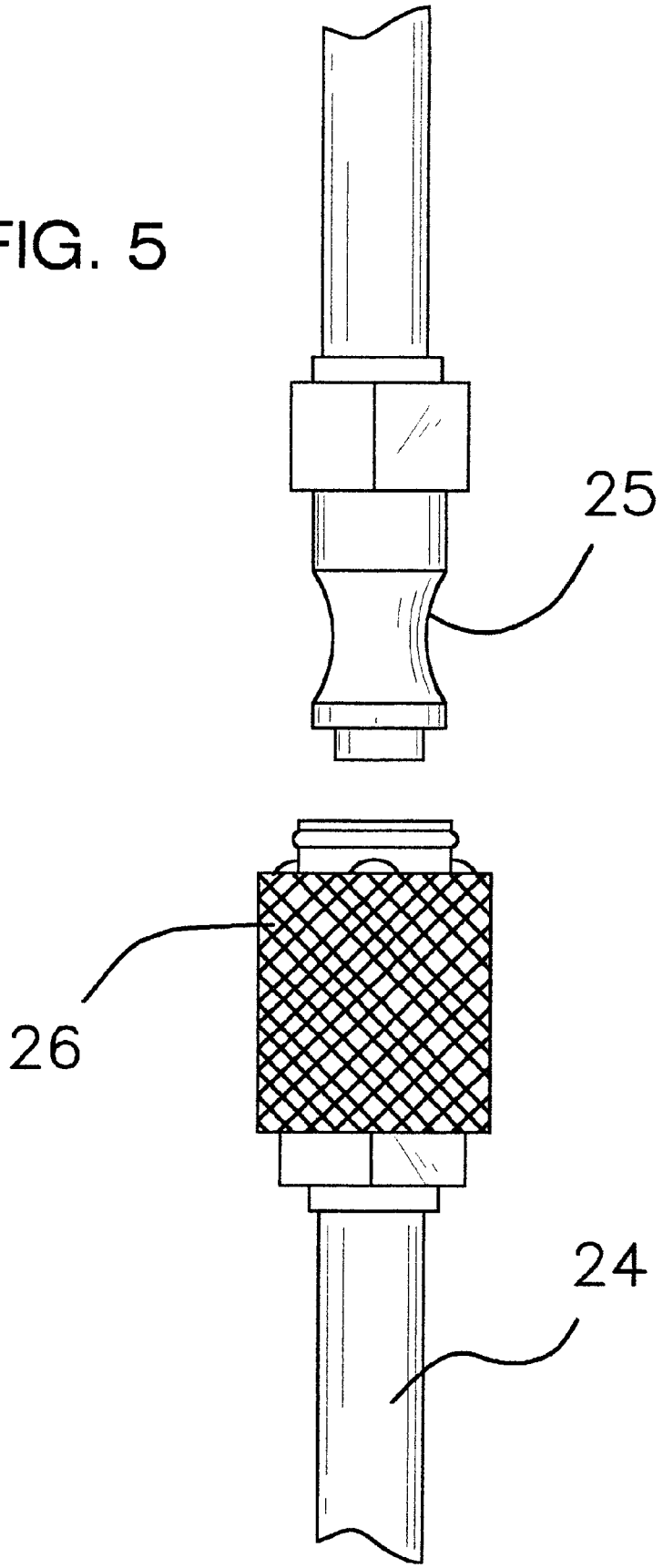
FIG. 5 is a schematic side view of a detachable coupling of the conduit system of the present invention taken from the circle 5 on FIG. 3.
Figure 6:
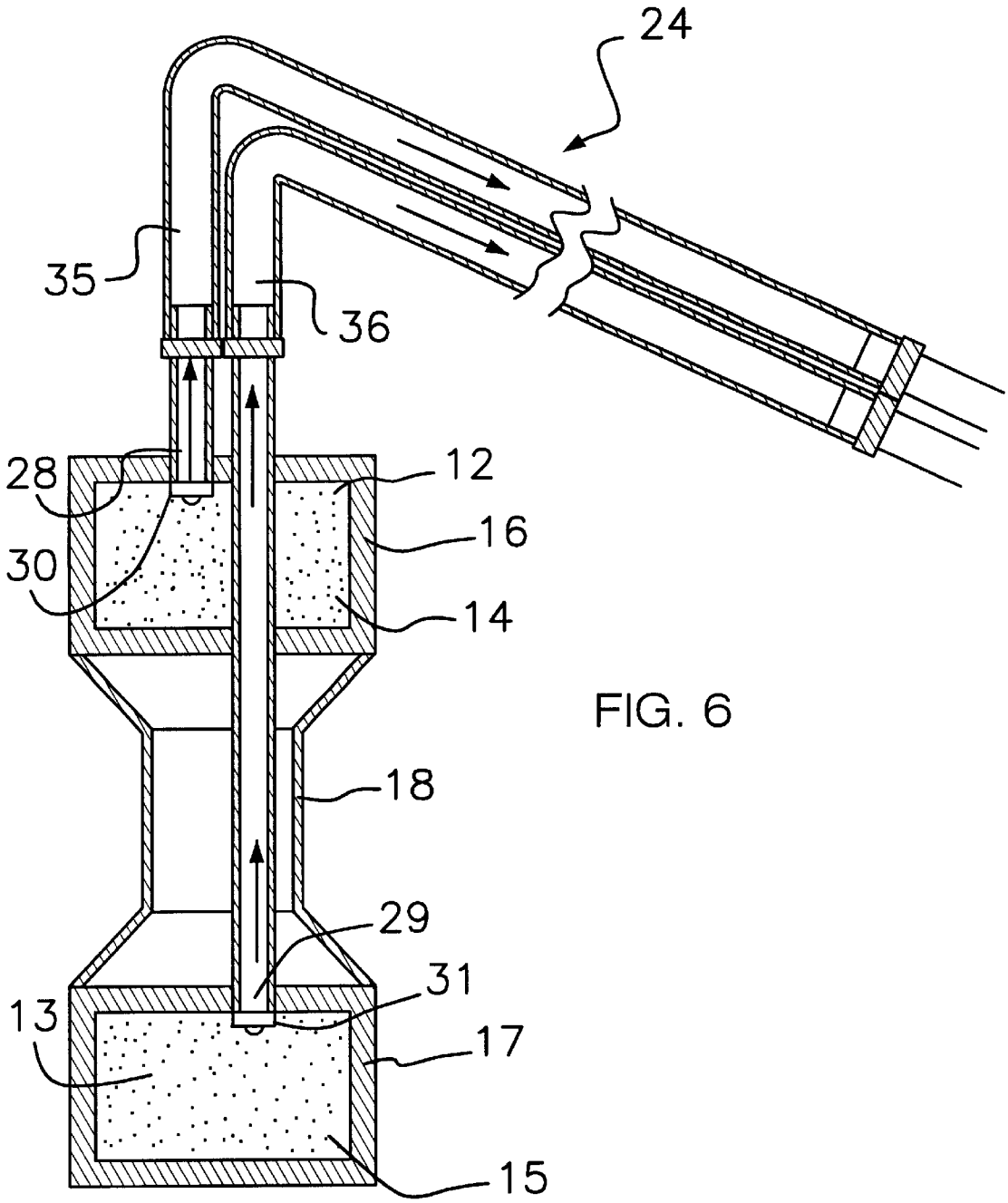
FIG. 6 is a schematic cross-sectional view of the container of the present invention taken from line 6—6 of FIG. 2.

The interior space of the inflatable bladder 20 is selectively in fluid communication with the reservoirs of the container 11. Preferably, an elongate conduit system 24 fluidly connects the interior space of the inflatable bladder 20 to the reservoirs of the container 11 to permit passage of foaming material from the reservoirs of the container 11 into interior space of the inflatable bladder 20. In use, the foaming material forms a foamed material (such as solidifying polyurethane of the type used for foamed insulation) in the interior space of the inflatable bladder 20 such that the foamed material inflates the inflatable bladder 20 to close the hole 2 in the structure 1. Ideally, the conduit system 24 comprises a pair of flexible tubes 35,36 or hoses and has a pair of opposite ends. One end of the conduit system 24 is fluidly connected to the reservoirs of the container 11 and the other end of the conduit system 24 is fluidly connected to the interior space of the inflatable bladder. The one end of the tubes of the conduit system 24 is preferably detachably attached to the container 11 while the other end of the tubes of the conduit system 24 are also preferably detachably attached to the inflatable bladder 20. With reference to FIG. 5, ideally, the detachable attachments of the ends of the conduit system 24 comprise a quick release plug 25 and socket 26 fluid connector. In the ideal embodiment, the inflatable bladder 20 also has a pair of valves 27 for closing the opening into the inflatable bladder 20 when the other end of the conduit system 24 is detached from the inflatable bladder 20.

In the preferred embodiment, the first tube 35 of the conduit system 24 has a first intake 28 opening into the first component reservoir 14 of the container 11 and the second tube 36 of the conduit system 24 has a second intake 29 opening into the second component reservoir 15 of the container 11. The conduit system 24 also preferably has first and second valves 30,31. The first valve 30 selectively closes the first intake 28 of one of the tubes of the conduit system 24 while the second valve 31 selectively closes the second intake 29 of another of the tubes of the conduit system 24. A release switch 32 is operationally connected to the first and second valves 30,31. The release switch 32 permits opening of the first and second valves 30,31 to permit the components of foaming material into the first and second intakes 28,29 of the conduit system 24. Preferably, the switch 32 is mounted on the exterior of the container 11 so that a user grasping the container can easily open valves. The switch may be comprised of an electrical solenoid or mechanical linkage that actuates the valves to allow the pressurized contents of the first and second component reservoirs to exit into the conduit system.

Figure 7:
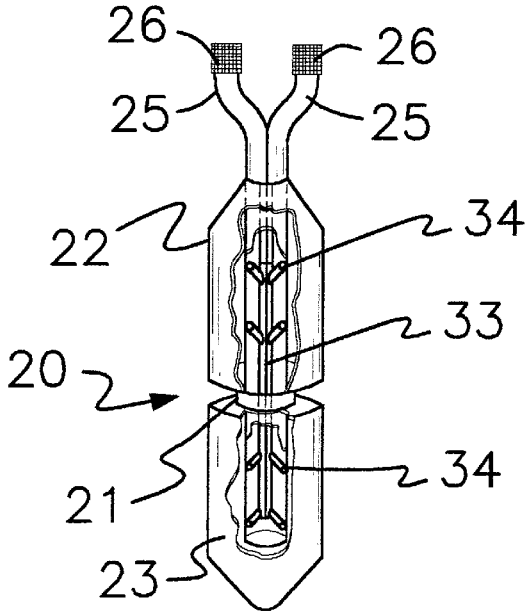
FIG. 7 is a schematic side view of the inflatable bladder of the present invention with a portion broken away to reveal interior detail of the bladder.

With reference to FIG. 7, the conduit system 24 has an elongate nozzle 33 in the interior space of the inflatable bladder 20. The nozzle 33 has an interior wall for preventing mixture of the two components of foaming material until both the components reach the interior of the bladder 20. The nozzle 33 has a plurality of apertures 34 providing openings into the conduit system 24. The apertures 34 of the nozzle 33 permit passage of foaming material from the conduit system 24 into the interior space of the inflatable bladder 20. As illustrated in FIG. 1, the inflatable bladder 20 is ideally folded around the nozzle 33 when the inflatable bladder 20 is deflated to help make it easier to insert the deflated inflatable bladder 20 in a hole 2 in a structure 1 as illustrated in FIG. 3.

In use, the foaming material passes into the conduit system 24 through the intakes 28,29 of the tubes 35,36 of the conduit system 24 and exits from the apertures 34 of the nozzle 33 of the conduit system 24 into the interior space of the inflatable bladder 20 to form a foam material which inflates the inflatable bladder 20. As illustrated in FIG. 8, the inflatable bladder 20 closes the hole 2 in the structure 1 from the both sides of the structure 1. Once the inflatable bladder 20 is inflated, water pressure on the portion 23 of the inflatable bladder 20 on the side of the structure 1 exposed to the water (such as the exterior side of a hull of a boat) presses the portion 23 of the inflatable bladder 20 against the structure 1 to help further keep the closure of the hole 2 in the structure 1 water tight.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A breach filling device for plugging a hole in a structure, said breach filling device comprising:

a container having a plurality of reservoirs therein for holding components of a foaming material therein;

a flexible inflatable bladder having an interior space;

a conduit system for fluidly connecting said reservoirs of said container with said interior space of said inflatable bladder, said conduit system being adapted to convey said components of said foaming material separately between said container and said inflatable bladder, said conduit system being adapted to discharge said components into said interior space of said bladder such that mixing of said components occurs in said interior space and said foaming material forms a foamed material in said interior space for inflating said inflatable bladder; and said container having a pair of spaced apart end portions and a generally cylindrical handle portion connecting said end portions of said container together.

2. The breach filling device of claim 1, wherein said inflatable bladder has an annular constriction around the circumference of said inflatable bladder, said annular constriction dividing said inflatable bladder into a pair of portions, and said annular constriction defining an annular channel between said portions of said inflatable bladder.

3. The breach filling device of claim 2, wherein said inflatable bladder is generally spherical, and wherein said portions of said inflatable bladder are generally hemispherical.

4. The breach filling device of claim 1, wherein an elongate conduit system fluidly connects said interior space of said inflatable bladder to said reservoirs of said container.

5. The breach filling device of claim 1, wherein said conduit system comprises a pair of flexible tubes, each of said tubes having a pair of opposite ends, a first end of said pair of ends of each of said tubes being fluidly connected to one of said reservoirs of said container, and a second end of said pair of ends of each of said tubes being fluidly connected to said interior space of said inflatable bladder.

6. The breach filling device of claim 5, wherein said first end of said tubes of said conduit system are detachably attached to said container, and said second end of said tubes of said conduit system are detachably attached to said inflatable bladder.

7. The breach filling device of claim 1, wherein said conduit system has an elongate nozzle in said interior space of said inflatable bladder, said nozzle having a plurality of apertures providing openings into said conduit system, said apertures of said nozzle permitting passage of said components of said foaming material from said conduit system into said interior space of said inflatable bladder.

8. The breach filling device of claim 1, wherein said foaming material comprises a two component foaming material, wherein said plurality of reservoirs of said container comprises separate first and second component reservoirs, said first component reservoir being for holding one of said components of said foaming material, said second reservoir for holding another component of said foaming material.

9. The breach filling device of claim 8, wherein a first tube of said conduit system has a first intake into said first component reservoir of said container, and wherein a second tube of said conduit system has a second intake into said second component reservoir of said container.

10. The breach filling device of claim 9, wherein said conduit system has first and second valves, said first valve selectively closing said first intake of said first tube of said conduit system, said second valve selectively closing said second intake of said second tube of said conduit system.

11. The breach filling device of claim 10, further comprising a switch being connected to said first and second valves, said switch permitting opening of said first and second valves to permit said components of said foaming material into said first and second intakes of said conduit system.

12. The breach filling device of claim 11, wherein said switch is mounted to said container.

13. A breach filling device for plugging a hole in a structure, said breach filling device comprising:

a container having a plurality of reservoir-therein for holding components of a foaming material therein, wherein said foaming material comprises a two component foaming material, wherein said plurality of reservoirs of said container comprises separate first and second component reservoirs, said first component reservoir being for holding one of said components of said foaming material, said second reservoir for holding another component of said foaming material;

wherein said container has a pair of spaced apart end portions and a generally cylindrical handle portion connecting said end portions of said container together;

a flexible inflatable bladder being generally spherical and having an interior space;

said inflatable bladder having an annular constriction around the circumference of said inflatable bladder, said annular constriction dividing said inflatable bladder into a pair of portions, said portions of said inflatable bladder being generally hemispherical, said annular constriction defining an annular channel between said portions of said inflatable bladder;

a conduit system for fluidly connecting said reservoirs of said container with said interior space of said inflatable bladder, said conduit system being adapted to convey said components of said foaming material separately between said container and said inflatable bladder, said conduit system being adapted to discharge said components into said interior space of said bladder such that mixing of said components occurs in said interior space and said foaming material forms a foamed material in said interior space for inflating said inflatable bladder;

wherein said conduit system comprises a pair of flexible tubes, each of said tubes having a pair of opposite ends, a first end of said pair of ends of each of said tubes being fluidly connected to one of said reservoirs of said container, and a second end of said pair of ends of each of said tubes being fluidly connected to said interior space of said inflatable bladder;

wherein said first end of said tubes of said conduit system are detachably attached to said container, and said second end of said tubes of said conduit system are detachably attached to said inflatable bladder;

wherein said conduit system has first and second valves, said first valve selectively closing said first intake of said first tube of said conduit system, said second valve selectively closing said second intake of said second tube of said conduit system;

wherein a first tube of said conduit system has a first intake into said first component reservoir of said container, and wherein a second tube of said conduit system has a second intake into said second component reservoir of said container;

a switch being connected to said first and second valves, said switch permitting opening of said first and second valves to permit said components of said foaming material into said first and second intakes of said conduit system; and wherein said conduit system has an elongate nozzle in said interior space of said inflatable bladder, said nozzle having a plurality of apertures providing openings into said conduit system, said apertures of said nozzle permitting passage of said components of said foaming material from said conduit system into said interior space of said inflatable bladder.

* * * * *